US005987954A

United States Patent [19]

Hauck et al.

[11] Patent Number: 5,987,954

[45] Date of Patent: Nov. 23, 1999

[54] ECCENTRIC-JOURNAL MOUNT FOR ROLLING-FRAME SUPPORT SHAFTS

[75] Inventors: Albert Hauck, Hilchenbach; Rüdiger Grimmel, Netphen, both of Germany

[73] Assignee: SMS Schloemann-Siemag AG, Dusseldorf, Germany

[21] Appl. No.: 08/985,600

[22] Filed: Dec. 5, 1997

[30] Foreign Application Priority Data

Dec. 6, 1996 [DE] Germany ..... 196 50 580

[51] Int. Cl.[6] ..... B21B 31/07

[52] U.S. Cl. ..... 72/248; 72/237

[58] Field of Search ..... 72/237, 238, 239, 72/246, 248

[56] References Cited

U.S. PATENT DOCUMENTS

| | | | |
|---|---|---|---|
| 3,143,786 | 8/1964 | Jones . | |
| 5,127,251 | 7/1992 | Casagrande et al. | 72/248 |
| 5,400,632 | 3/1995 | Castellani | 72/248 |
| 5,743,126 | 4/1998 | Shore et al. | 72/248 |

FOREIGN PATENT DOCUMENTS

| | | | |
|---|---|---|---|
| 0197568 | 10/1986 | European Pat. Off. . | |
| 0824045 | 2/1993 | European Pat. Off. . | |
| 875035 | 4/1953 | Germany . | |
| 1452139 | 5/1969 | Germany . | |
| 3703756 | 8/1988 | Germany | 72/248 |

OTHER PUBLICATIONS

"odern High Speed Rod Mill Development" *Iron and Steel Engineerm* Jul. 1969 p. 59ff.

*Primary Examiner*—Lowell A. Larson
*Assistant Examiner*—Ed Tolan
*Attorney, Agent, or Firm*—Herbert Dubno; Andrew Wilford

[57] ABSTRACT

A rolling apparatus has a frame and a first eccentric journal sleeve mounted on the frame, defining a first axis, and having axially inner and outer ends. A first shaft journaled in the sleeve has respective inner and outer ends at the first-sleeve inner and outer ends. The first-shaft outer end projects axially from the frame and carries a workpiece-deforming first roller. A rocker is displaceable transversely of the axis on the frame and carries a second eccentric journal sleeve defining a second axis generally parallel to the first axis and having axially inner and outer ends. A second shaft journaled in the second sleeve has respective inner and outer ends at the second-sleeve inner and outer ends. The second-shaft outer end also projects axially from the frame and carries a workpiece deforming second roller forming with the first roller a workpiece-receiving nip. Respective first and second drive gears engaging the respective first and second shafts between the respective ends rotate same about the respective axes. an actuator having a radially displaceable element urges the rocker radially toward the first axis and for holding the first and second axes at a predetermined spacing from each other at the outer ends.

7 Claims, 4 Drawing Sheets

A1
A2
II
WK
16
16a
4
1a
6
2a
7
3
5
8c
1
5
8
1c
8b
2
2c
2b
1b
11
9
10
II

A1
1a
6
4
8a
8
4b
13
15
1
12
1c
5
8b
14
1b
d
A9
8
9
10

ECCENTRIC-JOURNAL MOUNT FOR ROLLING-FRAME SUPPORT SHAFTS

FIELD OF THE INVENTION

The present invention relates to a rolling frame. More particularly this invention concerns an eccentric-journal mount for the support shafts of the rollers of such a frame.

BACKGROUND OF THE INVENTION

A standard rolling stand, for instance for reducing rod or bar stock, has a frame and first and second journal sleeves or chocks mounted on the frame, defining respective axes, and having axially inner and outer ends. Respective first and second shafts journaled in the sleeve have respective inner and outer ends at the sleeve inner and outer ends with both of the outer ends projecting axially from the frame. Workpiece-deforming first and second rollers are mounted cantilevered from the frame on the shaft outer ends. Respective first and second drive gears engage toothed portions of the first and second shafts between the respective ends for rotating same about the respective axes.

The advantage of this system is that the cantilevered workpiece-deforming rollers are highly accessible, making it easy to use the apparatus. Normally these rollers are of small diameter and are made of very hard material. Thus they can be rotated at high speed to deform the workpiece while using a relatively low pressure.

The main disadvantage of this system is that, since the rollers are only supported to one side of the nip, their relative positions are hard to control accurately. Thus such a rolling apparatus is good for roughing, but cannot normally be used to produce a workpiece of a caliber within a tight tolerance range.

OBJECTS OF THE INVENTION

It is therefore an object of the present invention to provide an improved rolling apparatus.

Another object is the provision of such an improved rolling apparatus which overcomes the above-given disadvantages, that is which can be used in high-tolerance applications to produce accurately dimensioned rolled products.

SUMMARY OF THE INVENTION

A rolling apparatus has according to the invention a frame and a first eccentric journal sleeve mounted on the frame, defining a first axis, and having axially inner and outer ends. A first shaft journaled in the sleeve has respective inner and outer ends at the first-sleeve inner and outer ends. The first-shaft outer end projects axially from the frame and carries a workpiece-deforming first roller. A rocker is displaceable transversely of the axis on the frame and carries a second eccentric journal sleeve defining a second axis generally parallel to the first axis and having axially inner and outer ends. A second shaft journaled in the second sleeve has respective inner and outer ends at the second-sleeve inner and outer ends. The second-shaft outer end also projects axially from the frame and carries a workpiece deforming second roller forming with the first roller a workpiece-receiving nip. Respective first and second drive gears engaging the respective first and second shafts between the respective ends rotate same about the respective axes. According to the invention an actuator having a radially displaceable element urges the rocker radially toward the first axis and holds the first and second axes at a predetermined spacing from each other at the outer ends.

This system allows one to adjust to a desired stiffness of the rolling frame. The small adjustment stroke of the elastic actuator does not influence the setting effected by the eccentric journal sleeves of the roller support shafts.

According to the invention the actuator is a piston-cylinder unit. This device not only sets the desired stiffness of the roller frame but allows the size of the rolling nip to be set very accurately.

The pivoting or inclining axis of the rocker can be axially movable in that according to the invention the rocker has an inner end mounted in the frame for axial displacement relative thereto. With a system where each roller has a semicircular groove, this structure allows the two grooves to be perfectly aligned with each other, with their centers of curvature coincident in the nip. Normally in accordance with the invention the rocker is pivotal about a rocker axis that is displaceable parallel to the second axis. An eccentric mount for a pin forming the rocker or an eccentric bearing can effect this. This eccentric mount of the pin ensures that when the pin rotates it does not move the rocker vertically.

The rocker according to the invention has transverse outer- and inner-end extensions respectively engaging the second sleeve outer and inner ends. The actuator is provided at the second-sleeve outer end.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
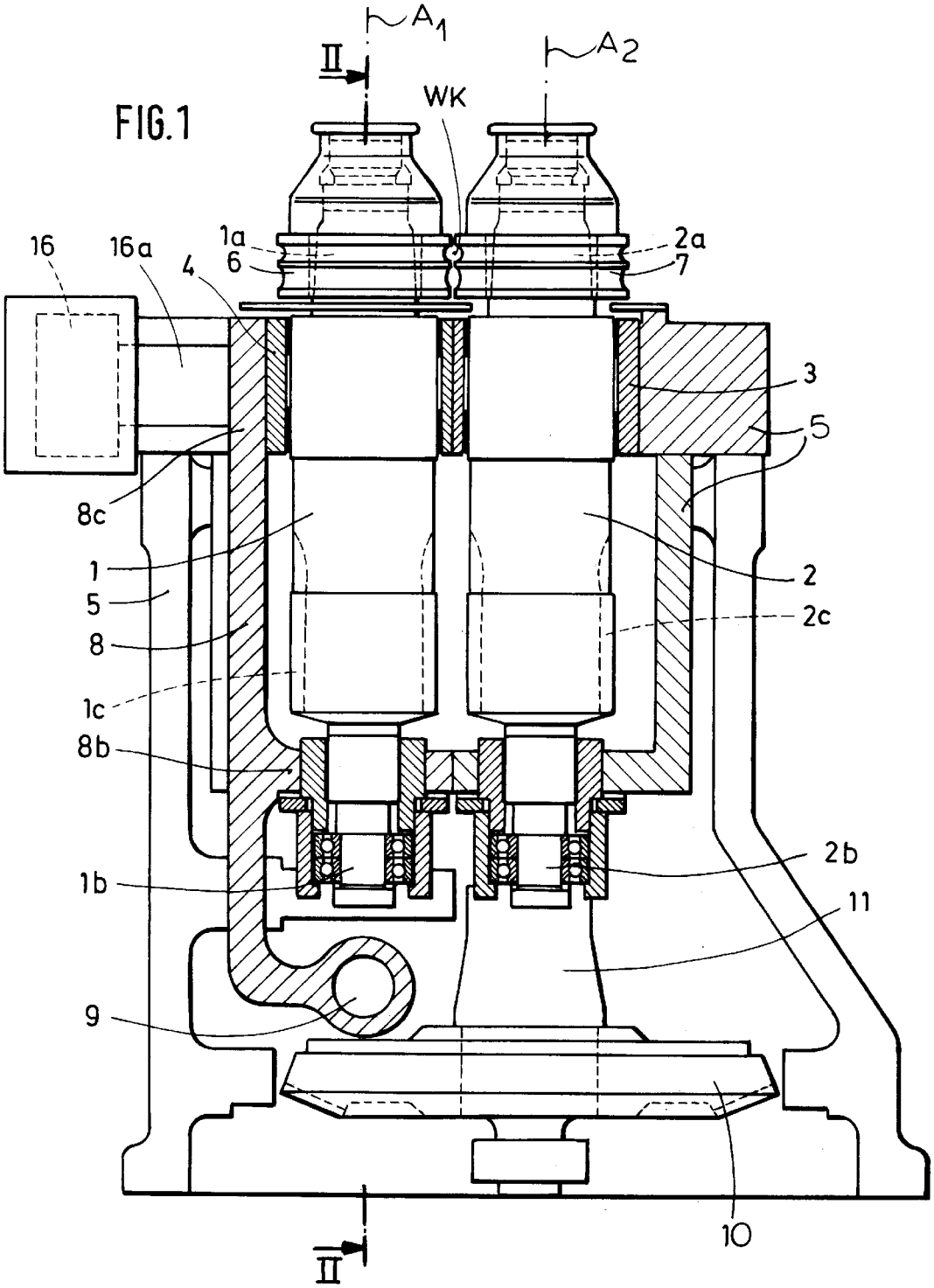
FIG. 1 is an axial section through the frame according to the invention.
Figure 2:
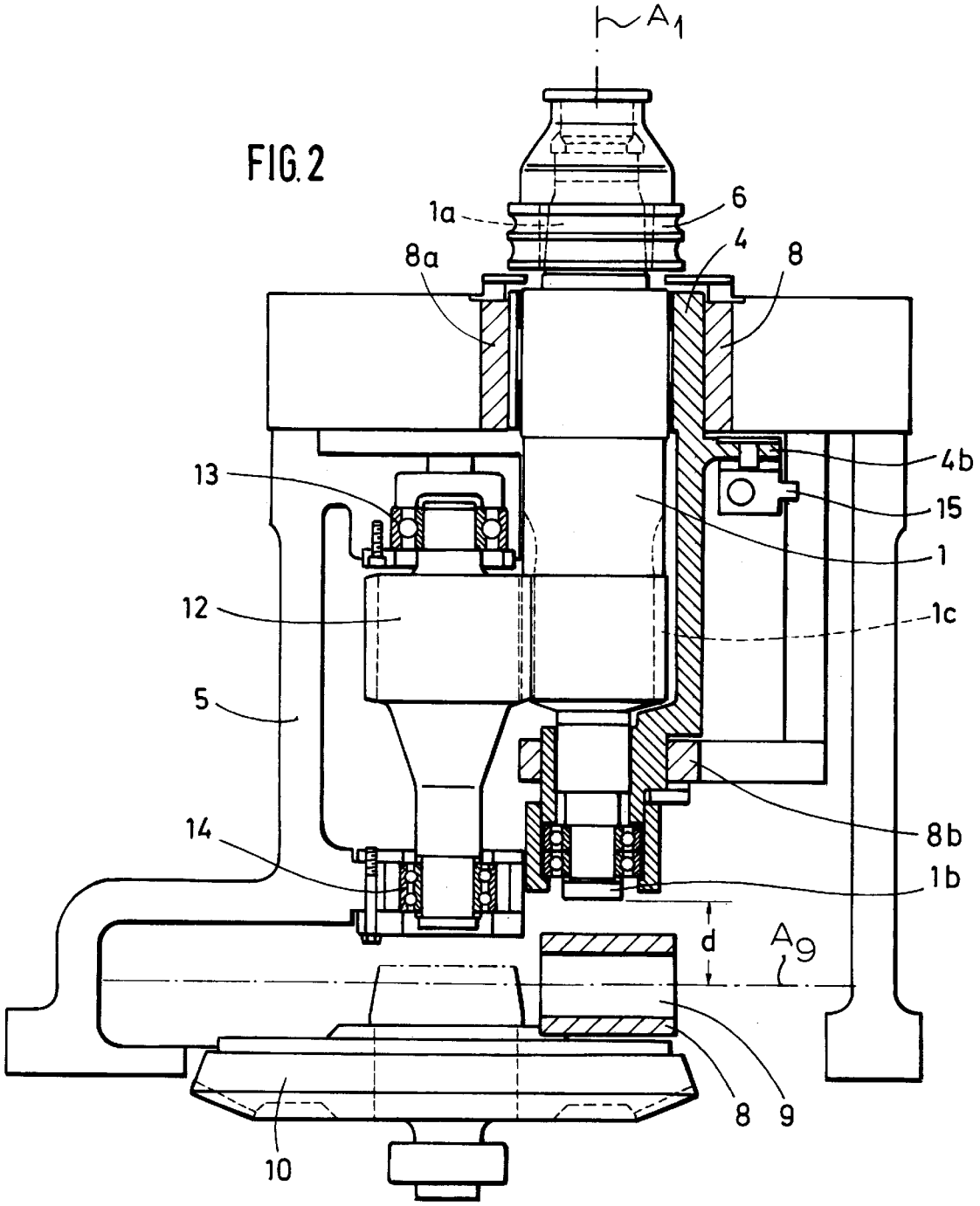
FIG. 2 is a section taken along plane II—II of FIG. 1.

As seen in FIGS. 1 and 2 a pair of substantially identical support shafts 1 and 2 centered on respective parallel and horizontal axes $A_1$ and $A_2$ are supported in respective eccentric chocks or journal sleeves 3 and 4. The sleeve 3 is fitted directly in a stationary frame or housing 5 and engages outer and inner ends 2*a* and 2*b* of the respective shaft 2. The sleeve 4 is mounted in a rocker 8 having outer and inner parts 8*a* and 8*b* carrying respective ends of the sleeve 4 which in turn engage outer and inner ends 1*a* and 1*b* of the shaft 1. The rocker 8 is pivotal on a pin 9 that can move eccentrically about an axis $A_g$ that is perpendicular to the axis $A_1$ and spaced inward from the inner end 1*b* therefrom by a distance d. The outer ends 1*a* and 2*a* carry respective double-grooved rollers 6 and 7 forming a pair of rolling nips WK for round bar stock.

Each of the shafts 1 and 2 has a central toothed region 1*c* and 2*c* engaged by a respective drive gear 11 and 12 supported in bearings 13 and 14 and projecting through respective radially throughgoing cutouts of the sleeves 3 and 4. The drive gear 11 is extended inward as a shaft carrying a large drive gear 10 and the two drive gears 11 and 12 mesh with each other for opposite rotation of the two shafts 1 and 2 about the respective axes $A_1$ and $A_2$. The chock sleeves 3 and 4 are of varying radial thicknesses and are each formed with a radial extension one of which is shown at 4*b*. An actuator 15 tangentially engages these extensions to oppositely rotate the sleeves 3 and 4 and thereby adjust the radial dimension of the nips WK in the manner well known in the art.

According to the invention the rocker 8 has an outer end 8*c* that is engaged with a piston rod 16*a* of an actuator 16 that serves to hold the journal 4 in place on the frame 5. This actuator 16 constitutes a biasing unit that determines how much transverse pressure is applied to the workpieces in the nips WK.

Figure 3:
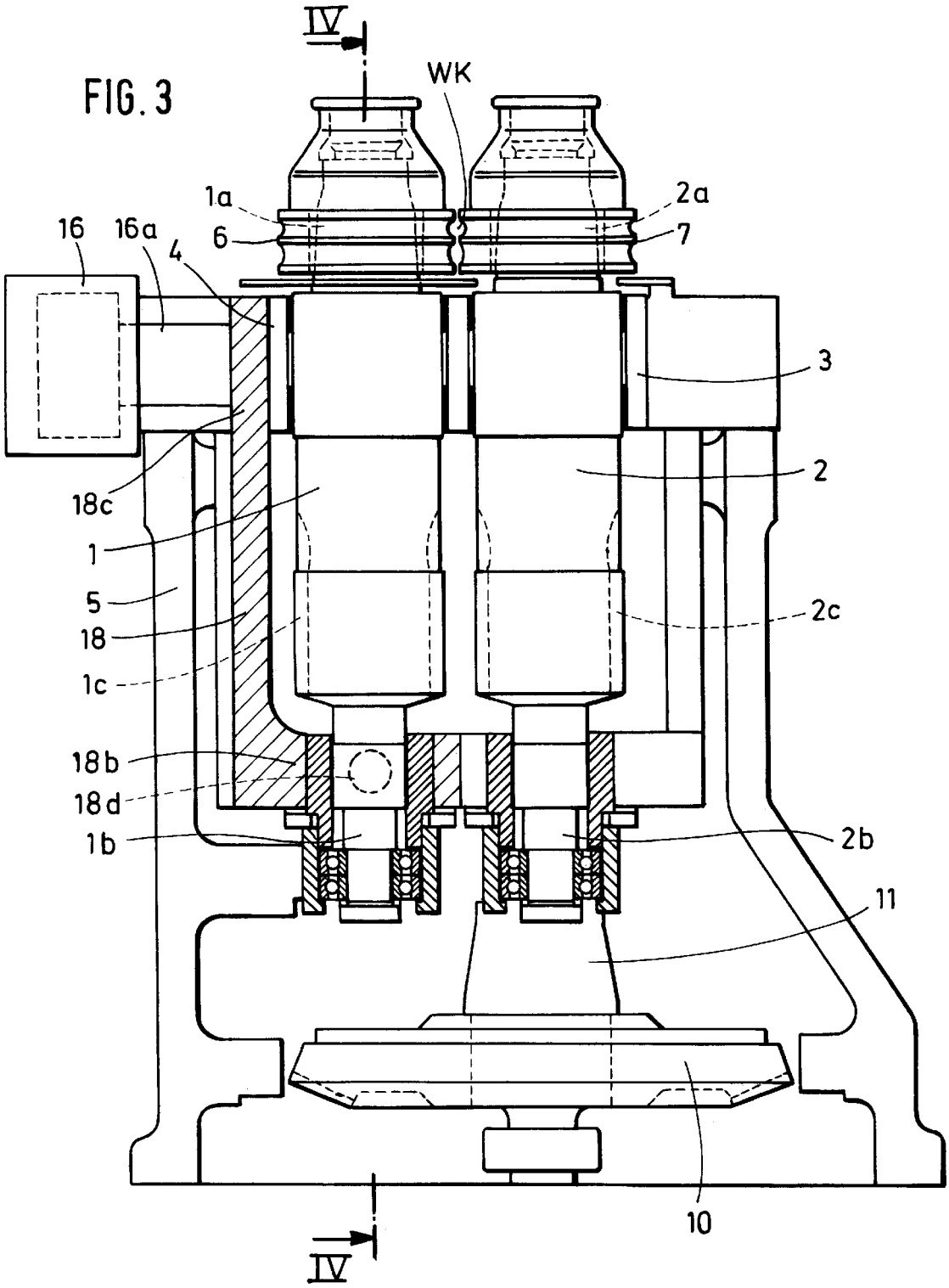
FIG. 3 is a view like FIG. 1 of another frame in accordance with the invention.
Figure 4:
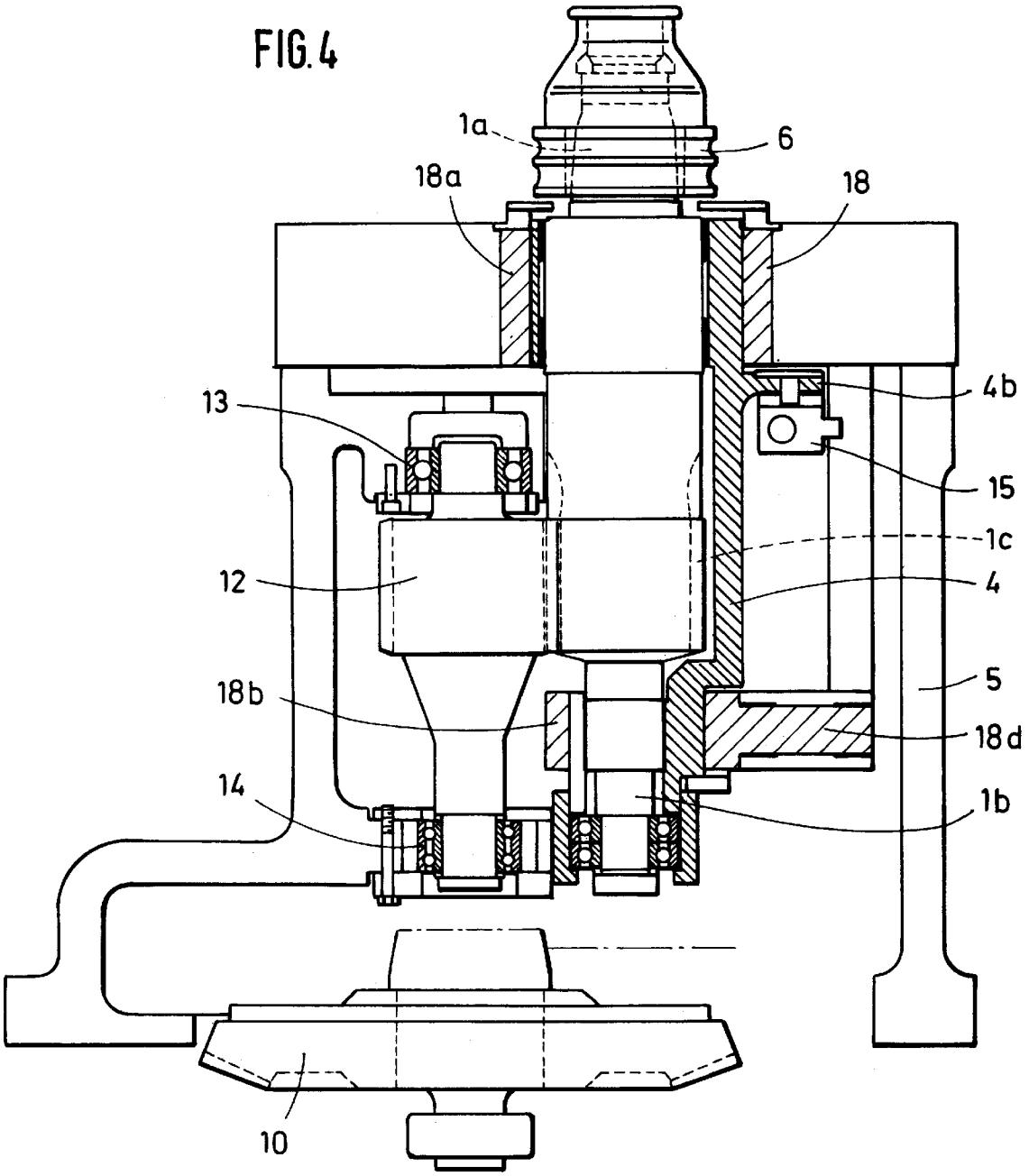
FIG. 4 is a section taken along plane IV—IV of FIG. 3.

In the arrangement of FIGS. 3 and 4 the rocker 8 carrying the journal 4 is carried by outer and inner ends 18*a* and 18*b* of a spring bar 18 with the inner end 18b displaceable parallel to the axis $A_1$ in the housing 5. Its outer end 18*c* is engaged by the actuator 16 and a radial projection 18*d* is engaged by the actuator 15 for axial positioning of the bar 18, the journal 4, and the shaft 1 and roller 6 fixed axially thereto. Due to the springiness of the bar 18, its end 18a can move independently of its end 18*b*

We claim:

1. A rolling apparatus comprising:

a frame;

a first eccentric journal sleeve mounted on the frame, defining a first axis, and having axially inner and outer ends;

a first shaft journaled in the sleeve and having respective inner and outer ends at the first-sleeve inner and outer ends, the first-shaft outer end projecting axially from the frame;

a workpiece-deforming first roller on the first shaft axially outward of the first-shaft outer end;

a rocker displaceable transversely of the axis on the frame;

a second eccentric journal sleeve mounted on the rocker, defining a second axis generally parallel to the first axis, and having axially inner and outer ends;

a second shaft journaled in the second sleeve and having respective inner and outer ends at the second-sleeve inner and outer ends, the second-shaft outer end projecting axially from the frame;

a workpiece deforming second roller on the second shaft axially outward of the second-shaft outer end and forming with the first roller a workpiece-receiving nips the shaft outer ends lying axially between the respective rollers and the respective inner ends;

means including respective first and second drive gears engaging the respective first and second shafts between the respective ends for rotating same about the respective axes; and means including an actuator having a radially displaceable element for urging the rocker radially toward the first axis and for holding the first axis at a predetermined spacing from the second axis at the outer ends.

2. The rolling apparatus defined in claim 1 wherein the actuator is a piston-cylinder unit.

3. The rolling apparatus defined in claim 1 wherein the rocker has an inner end mounted in the frame for axial displacement relative thereto.

4. The rolling apparatus defined in claim 1 wherein the rocker is pivotal about a rocker axis that is displaceable parallel to the second axis.

5. The rolling apparatus defined in claim 4 wherein the rocker has an eccentric bearing defining the rocker axis.

6. The rolling apparatus defined in claim 1 wherein the rocker has transverse outer- and inner-end extensions respectively engaging the second sleeve outer and inner ends.

7. The rolling apparatus defined in claim 1 wherein the actuator is provided at the second-sleeve outer end.

* * * * *